US006584441B1

(12) United States Patent
Ojala et al.

(10) Patent No.: US 6,584,441 B1
(45) Date of Patent: Jun. 24, 2003

(54) ADAPTIVE POSTFILTER

(75) Inventors: Pasi Ojala, Sääksjärvi (FI); Kari Järvinen, Tampere (FI)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/234,099

(22) Filed: Jan. 20, 1999

(30) Foreign Application Priority Data

Jan. 21, 1998 (FI) ..... 980132

(51) Int. Cl.[7] ..... G10L 19/14
(52) U.S. Cl. ..... 704/500; 704/200; 704/219
(58) Field of Search ..... 704/200, 219, 704/220–22, 224, 228–29, 258, 500, 503

(56) References Cited

U.S. PATENT DOCUMENTS

| | | | | |
|---|---|---|---|---|
| 4,617,676 A | | 10/1986 | Jayant et al. | 375/27 |
| 4,726,037 A | * | 2/1988 | Jayant | 704/500 |
| 4,969,192 A | | 11/1990 | Chen et al. | 381/31 |
| 5,327,519 A | | 7/1994 | Haggvist et al. | 395/2.28 |
| 5,444,816 A | | 8/1995 | Adoul et al. | 395/2.28 |
| 5,579,433 A | | 11/1996 | Jarvinen | 395/228 |
| 5,664,053 A | | 9/1997 | Laflamme et al. | 704/219 |
| 5,742,733 A | | 4/1998 | Jarvinen | 395/2.29 |
| 5,761,635 A | | 6/1998 | Jarvinen | 704/223 |
| 6,064,962 A | * | 5/2000 | Oshikiri et al. | 704/262 |

OTHER PUBLICATIONS

Finnish Search Report.
"GSM Enhanced Full Rate Speech Codec", International Conference on Acoustics, Speech Signal Processing, Jarvinen et al., 1997.
"Enhanced Full Rate Speech Codec for IS–136 Digital Cellular System", International Conference on Acoustics, Speech and Signal Processing, Honkanen et al., 1997.

* cited by examiner

*Primary Examiner*—Daniel Abebe
(74) *Attorney, Agent, or Firm*—Perman & Green, LLP

(57) ABSTRACT

The invention relates to the coding of speech at a variable bit rate, whereby the bit rates can vary from frame to frame, and more specifically to the methods and filters used for improving the quality of the decoded speech. In the solution according to the invention the weighting factors of the postfilter are not adapted on the basis of the momentary bit rate or the bit rate used in the coding of each frame, but the weighting factors are adapted according to the average bit rate calculated on the basis of a predetermined length of time. In addition to this, the weighting factors of the postfilter are also adjusted on the basis of whether the frame in question contains a voiced speech signal, an unvoiced speech signal or background noise. At frames containing an unvoiced speech signal or background noise, postfiltering is weakened so as to avoid the distortion of the signal tone because the postfiltering is adapted to a voiced signal. The weighting factors of the postfilter can also be adapted on the basis of the error rate or other parameter describing the quality of the signal or the data transfer channel. For example, postfiltering can conveniently be adjusted so that when the channel error rate and the amount of coding error increase, postfiltering is increased, whereby the effect of data transfer errors on the decoded speech signal is reduced and the tolerance of the system with regard to data transfer errors increases.

14 Claims, 9 Drawing Sheets

ADAPTIVE POSTFILTER

RANGE OF THE INVENTION

Figure 1:
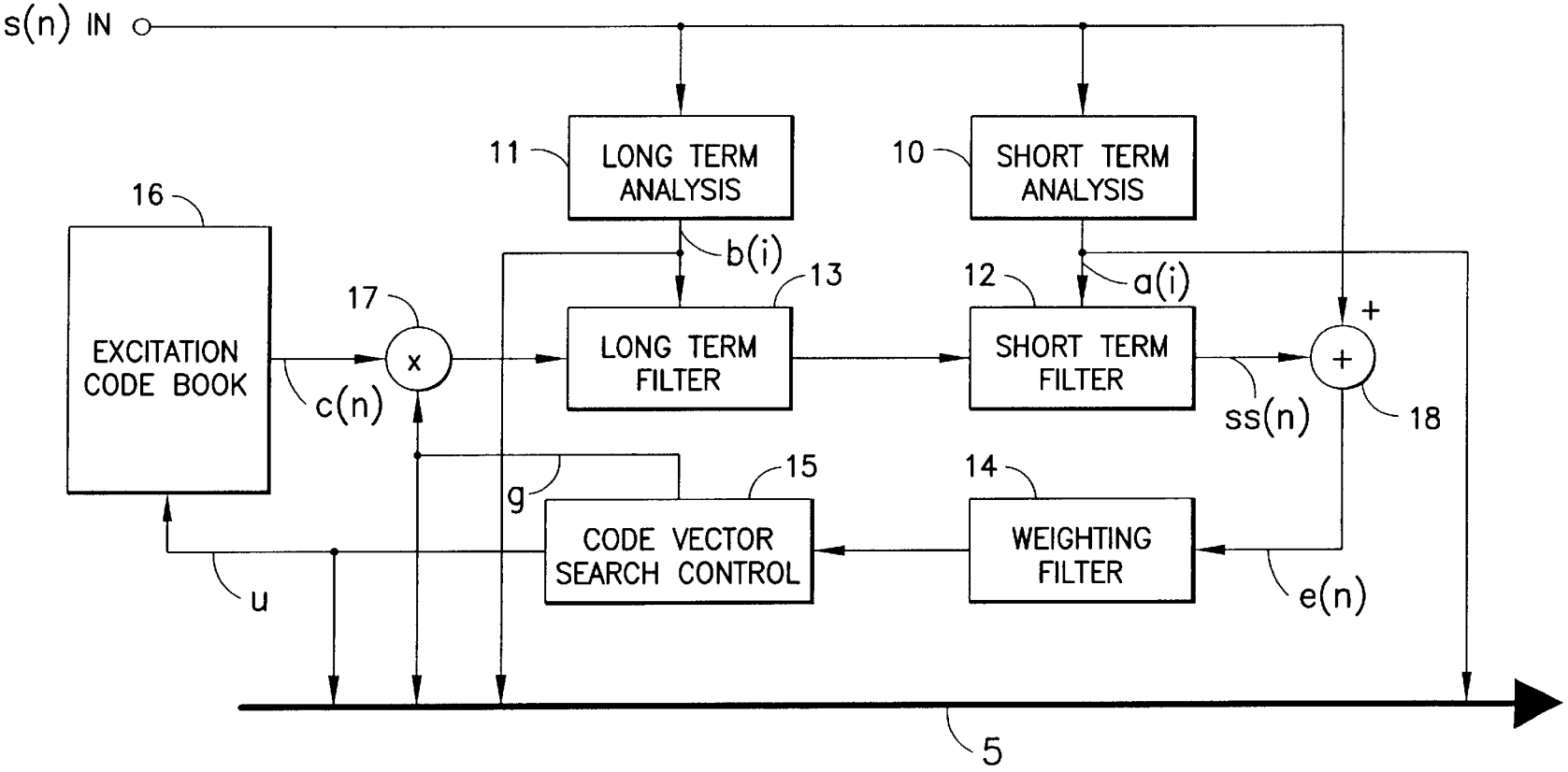
FIG. 1 PRIOR ART

The invention relates to the coding of speech at variable bit rates, whereby the bit rates can vary from frame to frame, and more specifically to the methods and filters used for improving the quality of decoded speech.

BACKGROUND OF THE INVENTION

The coding of speech at a variable bit rate can be used to maximize the capacity of a data transfer connection at a certain level of speech quality, or to minimize the average bit rate of a speech connection. This is possible because speech is not homogeneous, and if speech is divided into short sections, different sections can be presented using a different number of bits in each section without a perceivable difference in quality. Codecs using a fixed bit rate must operate at a kind of compromise rate, which is not too high in order to save data transfer capacity, but high enough to present different parts of speech with sufficient quality. This compromise rate is needlessly high for the sounds that could be presented with a smaller number of bits. The variable-rate method of speech coding can be used to advantage in many applications. Packet-switched networks, such as internet, can use variable-rate communications directly by sending different sized packages. The Code Division Multiple Access (CDMA) systems can also directly utilize variable-rate coding. In the CDMA systems, the average fall of the transmission rate reduces the mutual disturbances caused by different transmissions and makes it possible to increase the number of users. In the so-called third generation mobile station systems, variable-rate data transfer is likely to be used in some form. In addition to data transfer, variable-rate coding is also useful in connection with voice recording and voice message systems, such as telephone answering machines, where the saving due to variable-rate coding is seen as saved recording capacity.

The bit rate of a variable-rate codec can be controlled in many ways. One way is based on monitoring the capacity of the data transfer network, whereby the momentary bit rate is determined according to the available capacity. In a system like this, the bit rate can also be set an upper and lower limit on the basis of the capacity in use. The limits of the capacity are seen as reduced speech quality particularly during times of congestion, when the system forces the bit rate down.

Variable-rate coding can also be used to implement an error-tolerant coding method for mobile stations. In a method like this, the bit rate of speech coding is adapted on the basis of the quality of the transmission channel. When the quality of the transmission channel is good, the bit rate is kept relatively high and in addition to the coded speech only a little error correction information is transferred. In good transmission conditions, this method is sufficient to remove transmission errors. When the quality of the transmission channel becomes worse, the bit rate is lowered, whereby stronger channel coding can be used in an ordinary fixed-rate transmission channel. Then the reduction of speech quality is minimized by means of this stronger channel coding, which can correct larger errors. However, speech quality is reduced somewhat when the quality of the transmission connection is weakened, because the bit rate is lowered.

A typical CELP coder (Code Excited Linear Prediction) comprises many filters modelling speech formation, for which a suitable excitation signal is selected from the excitation vectors contained by the codebook. A CELP coder includes typically both short-term and long-term filters, in which a synthesized version of the original speech signal is formed by filtering excitations selected from the codebook. An excitation vector producing the optimum excitation signal is sought from the excitation vectors of the codebook. During the search, each excitation vector is applied to the synthesizer, which includes both short-term and long-term filters. The synthesized speech signal is compared to the original speech signal, taking account of the response of the human hearing capacity, whereby a characteristic comparable to the observed speech quality is obtained. An optimum excitation vector is obtained for each part of the speech signal being processed by selecting from the codebook the excitation vector which produces the smallest weighted error signal for the part of the speech signal in question. CELP coders like this are described in more detail in the patent specification U.S. Pat. No. 5,327,519, for instance.

FIG. 1 shows an example of a block diagram of a prior art fixed-rate CELP coder. The coder comprises two analysis blocks, namely the short-term analysis block 10 and the long-term analysis block 11. These analyse the speech signal s(n) to be coded, the short-term analysis block mostly the formants of the spectrum of the speech signal and the long-term analysis block mostly the periodicity (pitch) of the speech signal. The blocks form multiplier sets a(i) and b(i), which determine the filtering properties of the short-term and long-term filter blocks. The multiplier set a(i) formed by the short-term analysis block corresponds to the formants of the spectrum of the speech signal to be coded, and the multiplier set b(i) formed by the long-term analysis block corresponds to the periodicity (pitch) of the speech signal to be coded. The multiplier sets a(i) and b(i) are sent to the receiver through the data transfer channel 5. The multiplier sets are calculated separately for each frame of the speech signal to be coded, the temporal length of the frames being typically 20 ms.

The long and short-term filter blocks 13, 12 filter excitations selected from the codebook according to the multiplier sets a(i) and b(i). The long-term filter thus models the periodicity (pitch) of the voice, or the vibration of the vocal cords, and the short-term filter models the formants of the spectrum, or the human voice formation channels. The filtering result ss(n) is reduced from the speech signal s(n) to be coded in the summing device 18. The residual signal e(n) is taken to the weighting filter 14. The properties of the weighting filter are chosen according to the human hearing capacity. The weighting filter attenuates the frequencies which are perceptually less important, and emphasizes those frequencies which have a substantial effect on the perceived speech quality. The code vector search control block 15 searches on the basis of the output signal of the weighting filter a corresponding excitation vector index u. The excitation codebook 16 forms the desired excitation on the basis of the code vector corresponding to the index, and the excitation is fed to the multiplication device 17. The multiplication device forms the product of the excitation and the weighting factor g of the excitation given by the code vector search control block, which product is fed to the filter blocks 12, 13. The code vector search control block searches iteratively for an optimum excitation code vector. When the residue signal e(n) is at the minimum or sufficiently small, the desired code vector is considered to be found, whereby the index u of the excitation code vector and the weighting factor g are sent to the receiver.

Figure 2:
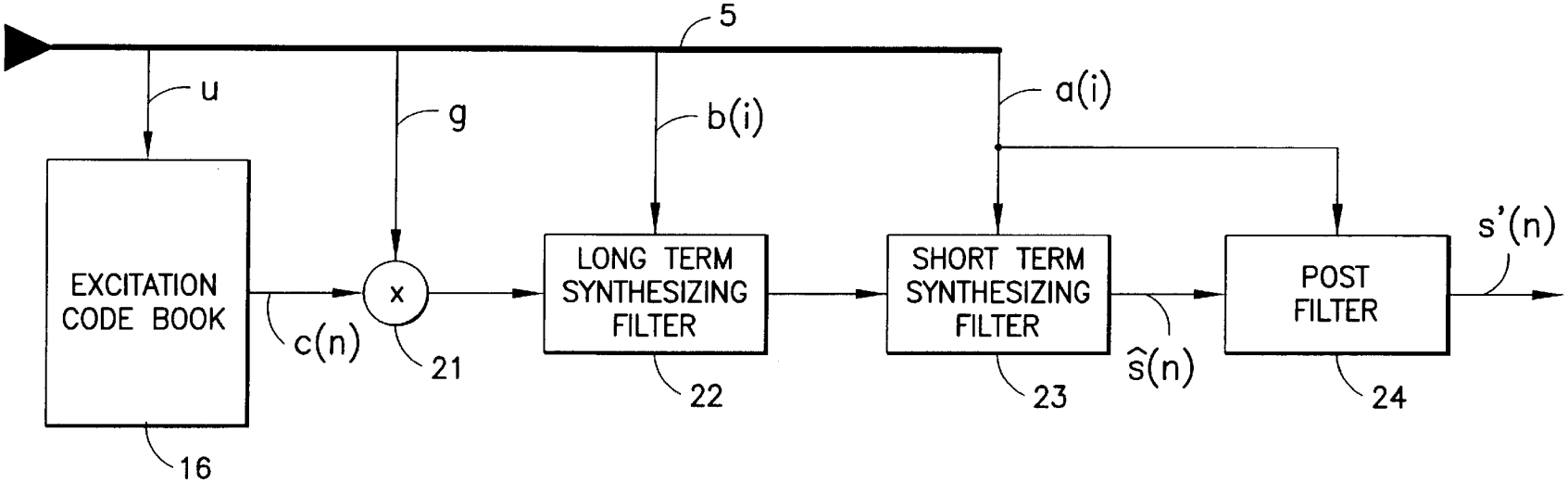
FIG.2 PRIOR ART

FIG. 2 shows an example of a block diagram of a prior art CELP decoder. The decoder receives the coding parameter sets a(i) and b(i), the weighting factor g and the excitation code vector index u from the data transfer channel 5. An excitation code vector corresponding to the index u is selected from the excitation codebook, and a corresponding excitation c(n) is multiplied in the multiplication device 21 with the weighting factor g. The resulting signal is fed to the long-term synthesizing filter 22 and further to the short-term synthesizing filter 23. The coding parameter sets a(i) and b(i) control the filters 22, 23 in the same way as in the coder of FIG. 1. The output signal of the short-term filter is filtered further in a postfilter 24 for forming a reconstructed speech signal s'(n).

In a modification of CELP coding, namely the ACELP (algebraic code excited linear prediction), the excitation signal consists of a constant number of pulses differing from zero. An optimum excitation signal is obtained by selecting the optimum places and amplitudes of pulses with similar error criteria as in CELP coding. Coding like this is described e.g. in the conference publications Järvinen K., Vainio J., Kapanen P., Honkanen T., Haavisto P., Salami R., Laflamme C. and Adoul J-P, *GSM Enhanced Full Rate Speech Codec*, International Conference on Acoustics, Speech and Signal Processing, Munich, Germany, Apr. 21–24, 1997, and Honkanen T., Vainio J., Jarvinen K., Haavisto P., Salami R., Laflamme C. and Adoul J-P., *Enhanced Full Rate Speech Codec for IS*-136 *Digital Cellular System*, International Conference on Acoustics, Speech and Signal Processing, Munich, Germany, Apr. 21–24, 1997.

It is typical of low bit-rate codecs like this that because of inaccurate excitation modelling the voice quality as such would be poor. Because of this, the output signal of the codec is filtered in order to improve the perceivable speech quality. Both short and long-term filtering can be used in postfiltering like this. The filtering properties are regulated by means of weighting factors. The purpose of short-term postfiltering is to emphasize the formants of the spectrum and thus attenuate the frequencies surrounding them, which improves the perceived quality of speech. The purpose of long-term postfiltering is to emphasize the fine features of the spectrum. An example is a fixed 10th degree short-term postfilter, which is of the form $$H(z) = \frac{\sum_{i=0}^{10} \alpha^i b_i z^{-i}}{\sum_{i=0}^{10} \beta^i c_i z^{-i}} \tag{1}$$

wherein $b_i$ and $c_i$ are the determining factors of the short-term spectrum of the frame to be analyzed, and $\alpha$ and $\beta$ are weighting factors that regulate filtering. The weighting factors move the zeroes and poles of the short-term model of the filter closer to the origin. The values of the weighting factors are chosen individually for each codec type typically by means of listening tests. A postfilter like this can be weakened by moving the filter poles closer to the origin by reducing the value of the factor $\beta$ and/or moving the zeroes of the filter closer to the unit circle by increasing the value of the factor $\alpha$. A short-term postfilter can also be realized by means of a transfer function having only poles or zeroes.

It is a known fact that the lower the bit rate used in speech coding, the stronger postfiltering is needed to mask the distortion caused by coding. However, in the prior art variable-rate codecs, the same postfilter has been used with all bit rates. An example of a variable-rate codec like this is the QCELP codec, which is used in the IS-96 CDMA system.

However, the patent specification U.S. Pat. No. 4,617,676 discloses—in connection with ADPCM coding (Adaptive Differential Pulse Code Modulation)—a solution in which different weighting factors are used in the postfilter for speech signals coded at different bit rates. According to the specification, the weighting factors are changed while the bit rate used for coding is changed.

Using different postfilters for different bit rates entails the problem that when the bit rate and the postfilter are changed, the tone of the speech is also changed. The listener perceives this as discontinuity and disturbance. Because of this, in the prior art variable-rate codecs the weighting factors of the postfilter are typically kept constant. A postfilter that is adjusted according to the bit rate of each frame causes disturbances both in coding that takes place sample by sample (such as ADPCM) and in coding that takes place frame by frame (CELP).

Figure 3:
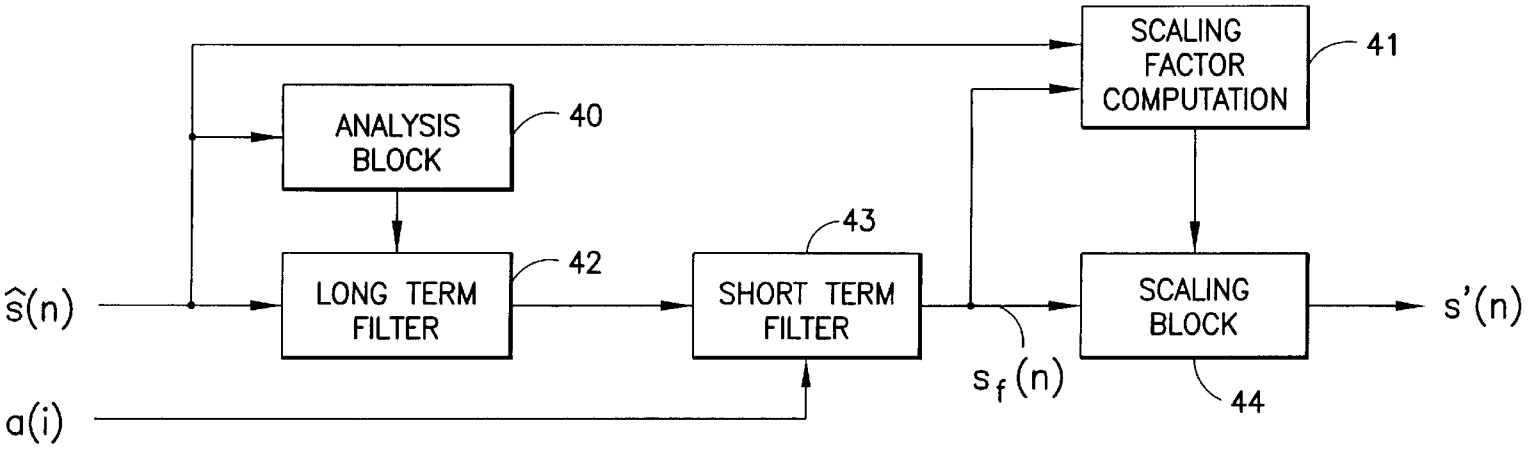
FIG.3 PRIOR ART

FIG. 3 shows a prior art adaptive postfilter as applied to an LD-CELP decoder according to the standard ITU-T G.728. The parameters and intensity of the pitch of decoded speech are analysed in the analysis block 40. These results are used to control the operation of the long-term postfilter block 42. The transfer function of the long-term postfilter block 42 is $$H_l(z)=g_i(1+bz^{-p}) \tag{2}$$

wherein p is the pitch-lag, b is the filter weighting factor and $g_i$ is the scaling factor. Suitable values for b and $g_i$ are, for example:

$$b = \begin{cases} 0, & \beta < 0.6 \\ 0.15\beta, & 0.6 \le \beta \le 1 \\ 0.15, & \beta > 1 \end{cases} \tag{3}$$

$$g_1 = \frac{1}{1+b} \tag{4}$$

wherein $\beta$ is the amplification factor of the single tap pitch predictor, whereby the pitch-lag is p samples. The pitch postfilter is constructed as a comb filter, in which the resonance peaks are at multiples of the pitch frequency of the speech being postfiltered. The transfer function of the short-term postfilter 43 is $$H(z) = \frac{\sum_{i=0}^{10} \gamma_1^i a_i z^{-i}}{\sum_{i=0}^{10} \gamma_2^i a_i z^{-i}} \tag{5}$$

wherein the weighting factor parameters $\gamma_1$=0.65 and $\gamma_2$=0.75 regulate the strength of the postfiltering and the factors a are the parameters that determine the short-term spectrum. Postfiltering can further be regulated by means of the tilt factor H'(z) as follows:

$$H'(z) = H(z)\frac{1}{1+\mu z^{(-i)}} \tag{6}$$

wherein $\mu=\gamma_3 k_1$, wherein $k_1$ is also the first reflection factor of a model for the short-term analysis block used in speech coding. The factors of the short-term model are obtained from the decoder. Because the gain of the signal can change in postfiltering, automatic gain control is used to keep the gain constant. The gain of decoded speech ·(n) is determined in the scaling factor computation block 41, after which the gain of the postfiltered speech s'(n) is adjusted to correspond to the gain of the decoded speech in the scaling block 44. The scaling factor of each frame is typically calculated according to the formula:

$$g = \sqrt{\frac{\sum_{n=0}^{L} s^2(n)}{\sum_{n=0}^{L} s_f^2(n)}}$$

wherein ·(n) is the decoded speech signal, $s_f$ is the signal after the short and long-term postfiltering blocks and L is the length of the frame to be analyzed. The scaling block 44 performs the multiplication $$s'(n)=gs_f(n) \tag{8}$$

In the GSM EFR standard, the weighting factors are $\gamma_1=0.7$, $\gamma_2=0.75$ and $\gamma_3=0.15$.

Figure 4:
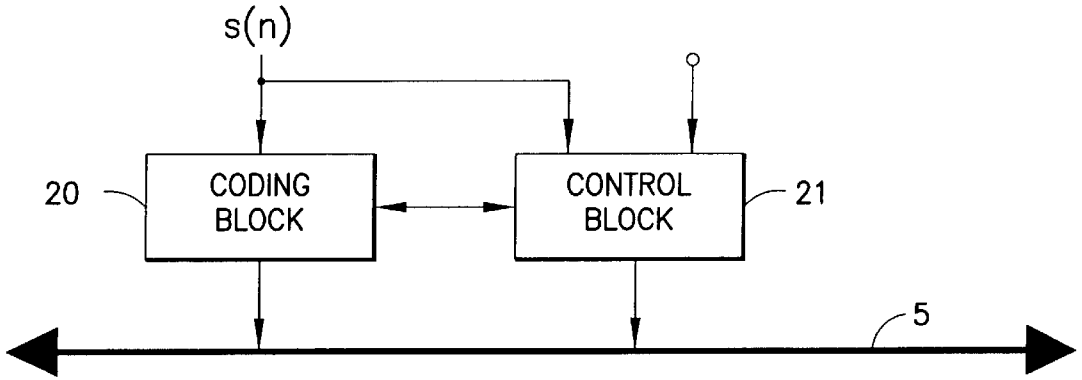
FIG.4 PRIOR ART

FIG. 4 shows a variable-rate coder controlled by the source signal and the data transfer network. The coding block 20 receives the speech signal to be coded s(n). The speech signal to be coded is also taken to the bit rate control block 21, which controls the bit rate according to the speech signal s(n). The control block 21 also receives a control signal O, which typically determines the highest and lowest allowed bit rate and the desired average bit rate. In addition to this information, the control block 21 can receive information of the quality of the coding and the quality of the data transfer channel and use this information for controlling the bit rate. For example, if the quality of the data transfer channel is bad, it is advantageous to lower the bit rate, whereby a stronger channel coding can be used. The data transfer channel is used to convey information of the parameters used by the coder, such as the bit rate, to the recipient.

Figure 5:
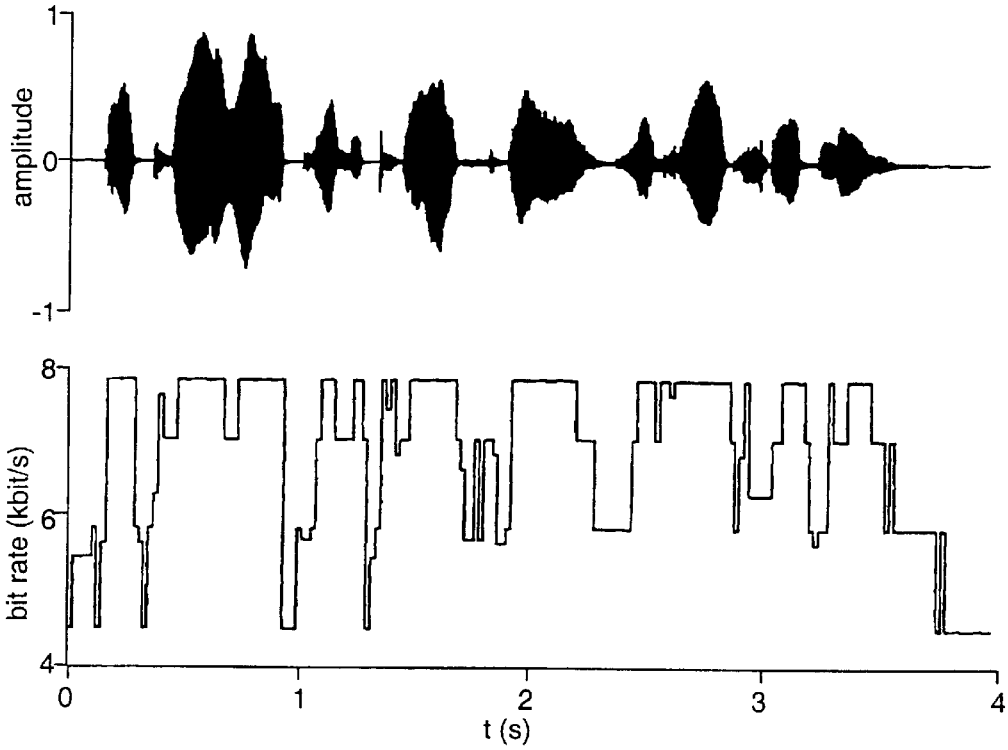
Fig. 5 PRIOR ART

FIG. 5 illustrates how the bit rate of a variable-rate coder controlled by a source signal, as in the example of FIG. 4, varies according to the source signal. The upper curve represents the speech signal and the lower curve the bit rate used by the coder. In principle, the bit rate can vary frame by frame. In the example of FIG. 5, the average bit rate is about 7.0 kbit/s.

The postfilter solutions used in variable-rate codecs entail yet another problem, which is not taking into account whether the sound in each frame is voiced, unvoiced or whether it is merely background noise. This problem arises particularly with low bit rates, which require a strong postfilter. Strong postfiltering distorts particularly the sound colour of unvoiced frames and frames containing only background noise. In frames like this, the signal spectrum is rather even and lacking of clear formants, which tend to be formed as a result of strong postfiltering. Thus the speech signal is easily distorted during frames like this, which is perceived by the listener as weakened quality of speech.

SHORT DESCRIPTION OF THE INVENTION

It is an object of the invention to improve the quality of speech in a telecommunication system which uses variable-rate speech coding. It is also an object of the invention to improve the quality of a speech signal decoded from a coded signal. In addition, the invention aims at improving the tolerance of a telecommunication system with respect to data transfer errors.

The objects are achieved by realizing a postfiltering system in which the postfiltering is adapted at least according to the long-term average bit rate, and by realizing a corresponding adaptive postfilter which adapts itself at least according to the long-term average bit rate.

The method according to the invention is characterized in what is stated in the characterizing part of the independent method claim. The invention also relates to a decoding system, which is characterized in what is stated in the characterizing part of the independent claim concerning a decoding system. The invention also relates to a mobile station, which is characterized in what is stated in the characterizing part of the independent claim concerning a mobile station. Furthermore, the invention relates to an element of a telecommunication system, which element is characterized in what is stated in the characterizing part of the independent claim concerning an element of a telecommunication system. The subclaims describe various advantageous embodiments of the invention.

In the solution according to the invention, the weighting factors of the postfilter are not adjusted according to the momentary bit rate, or the bit rate used in the coding of each frame, but the weighting factors are adjusted according to an average bit rate calculated for a certain period of time, for instance by calculating the average over several frames. In addition to this, the weighting factors of the postfilter are also adjusted according to whether each frame contains a voiced speech signal, unvoiced speech signal or background noise. Postfiltering is weakened at frames containing unvoiced speech signal or background noise, so that the tone of the signal would not be distorted at places like that because postfiltering is adapted to a voiced signal. In addition, the weighting factors of the postfilter can also be adapted on the basis of the error rate of the received signal or another signal or a parameter describing the quality of the data transfer channel. For example, postfiltering can advantageously be adjusted so that when the bit error rate increases, postfiltering is strengthened, whereby the effect of data transfer errors in the decoded speech signal is reduced and the tolerance of the system with regard to data transfer errors increases.

SHORT DESCRIPTION OF THE FIGURES

Figure 6:
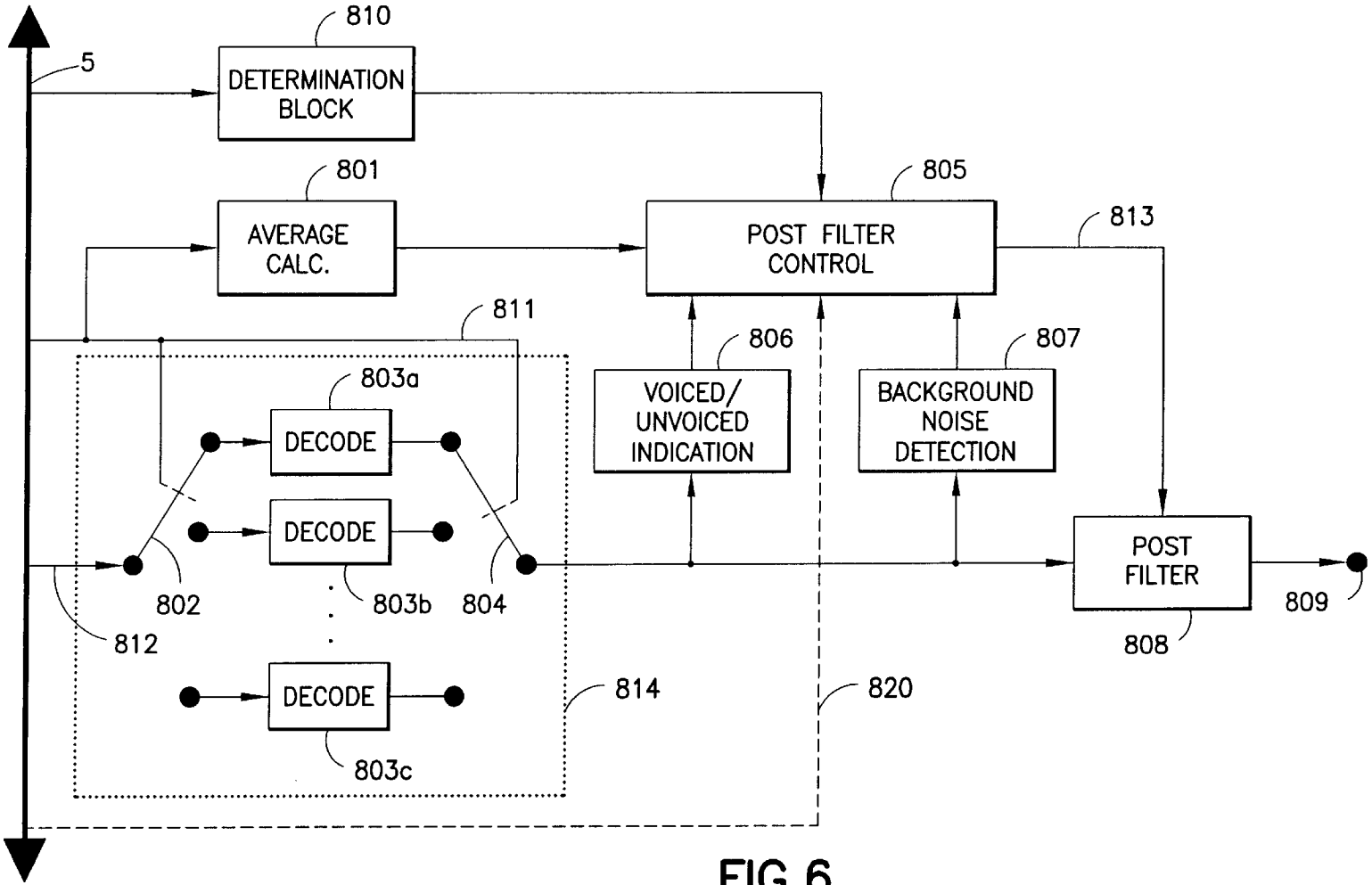
Figure 7:
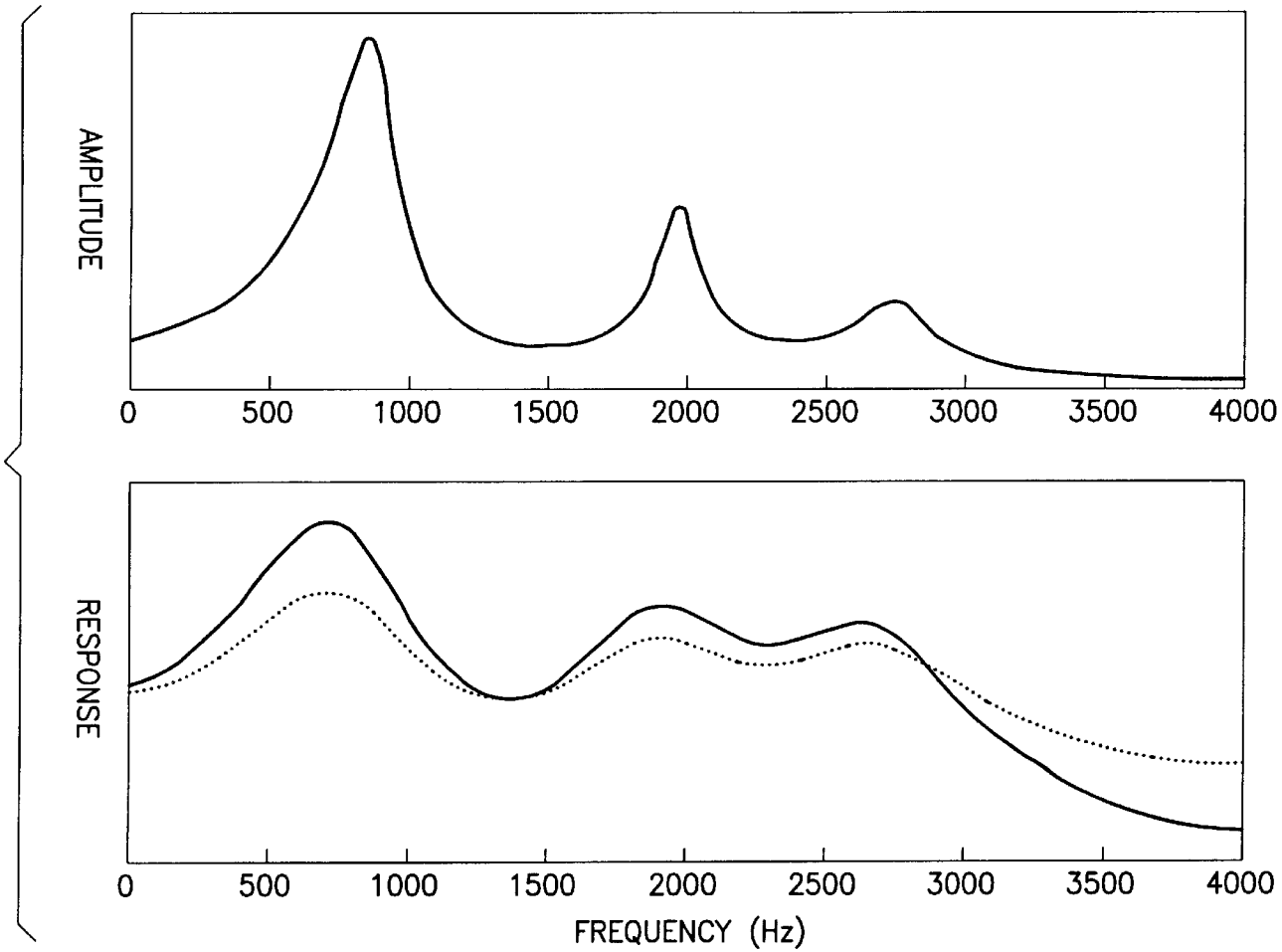
Figure 8:
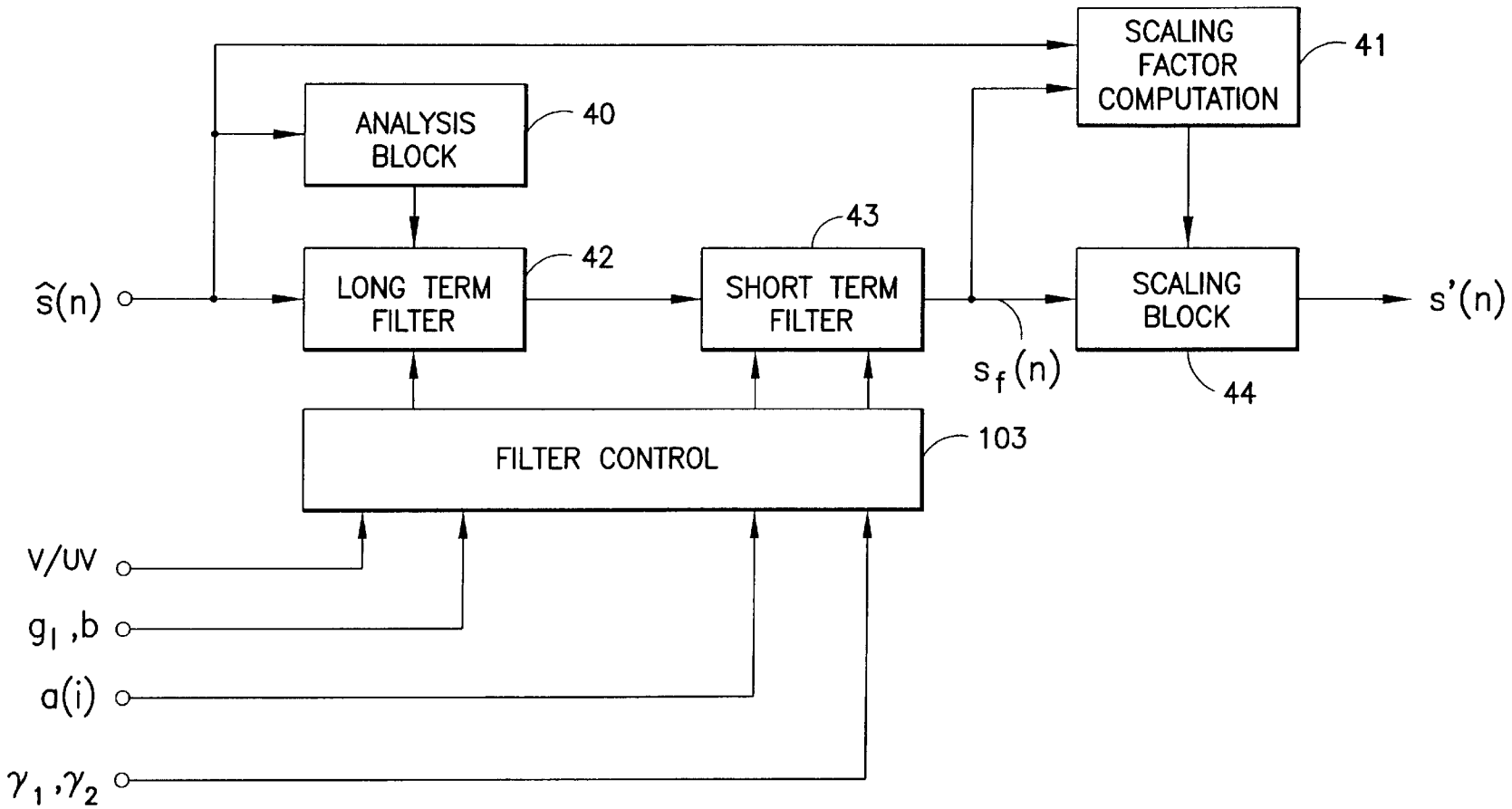
Figure 9:
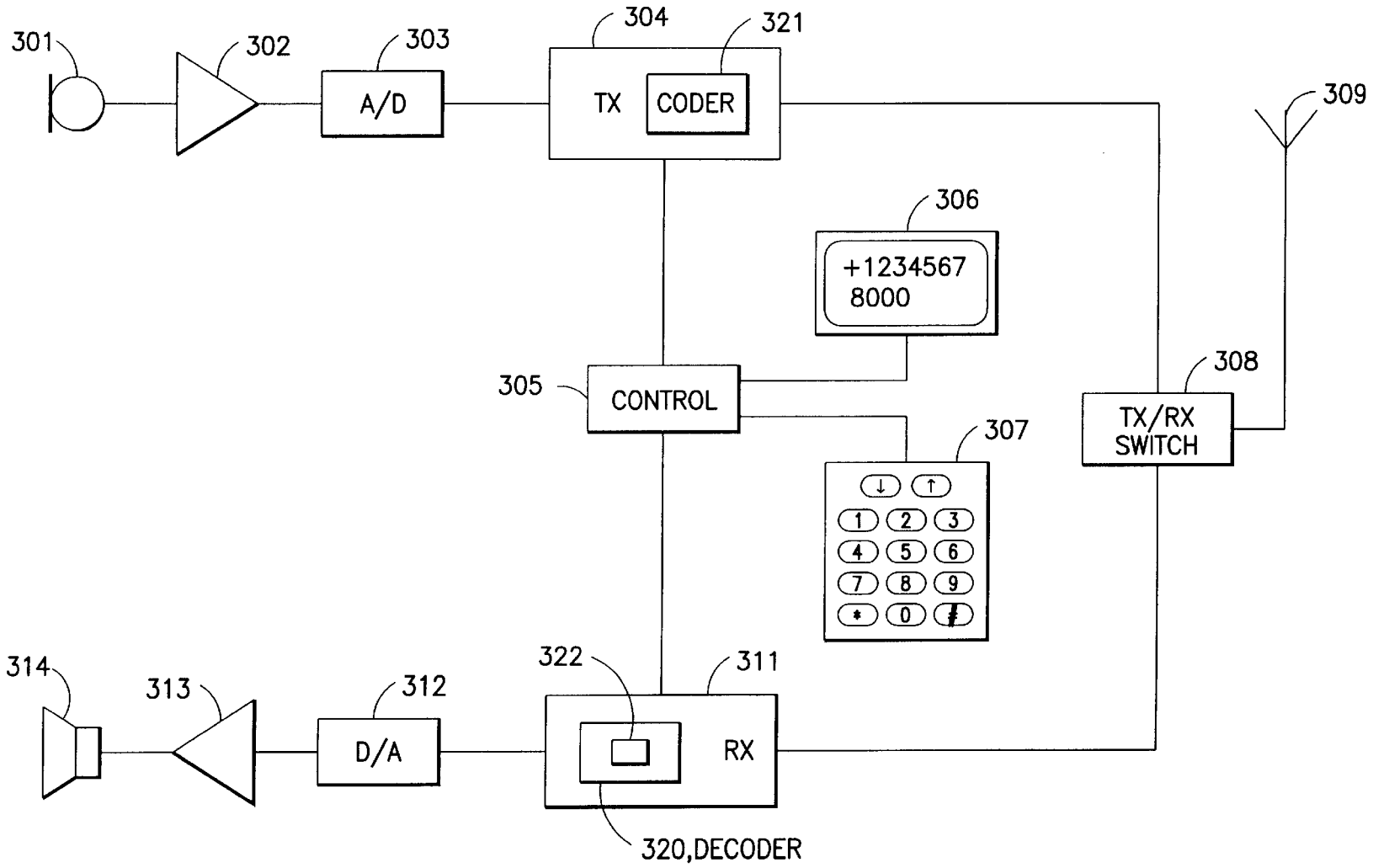
Figure 10:
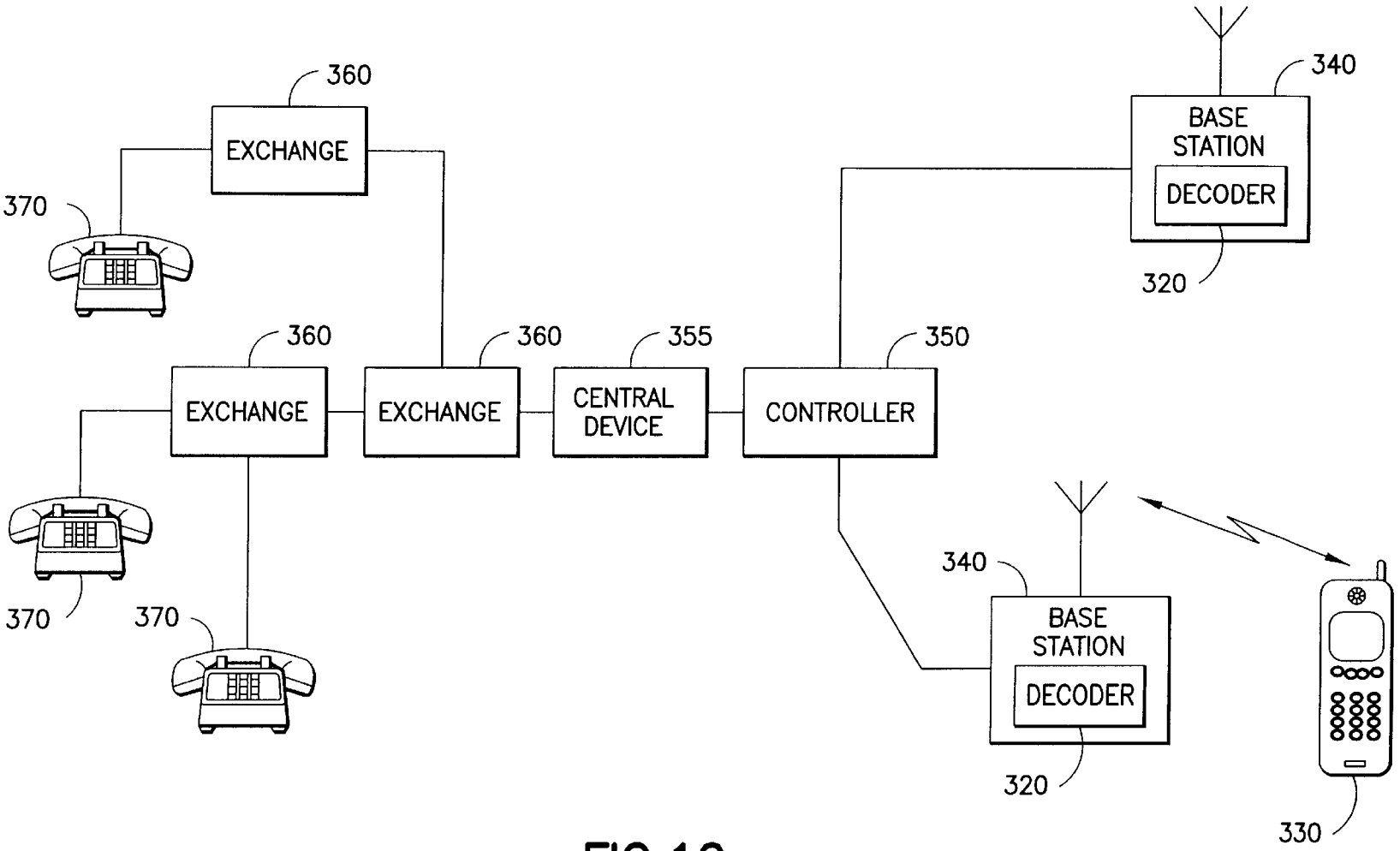

In the following, the invention will be described in more detail with reference to the preferred embodiments shown by way of example and the accompanying drawings, in which FIG. 1 shows a prior art CELP coder, FIG. 2 shows a prior art postfiltering solution, FIG. 3 shows a prior art decoder, FIG. 4 shows a block diagram of a prior art variable-rate coder, FIG. 5 shows an example of the changes of bit rate of a coded speech signal produced by a prior art variable-rate coder, FIG. 6 shows a decoder according to one preferred embodiment of the invention, FIG. 7 illustrates the adjustment of the frequency response of a short-term postfilter, FIG. 8 shows a postfilter construction of a preferred embodiment of the invention, FIG. 9 shows a block diagram of a preferred embodiment of the invention, and FIG. 10 shows a block diagram of an embodiment of the invention.

The same reference numbers and markings are used in the figures for corresponding parts.

DESCRIPTION OF SOME PREFERRED EMBODIMENTS OF THE INVENTION

FIG. 6 shows a block diagram of a decoder according to a preferred embodiment of the invention. The decoder has a variable-rate decoding block 814, which in a multiple-rate application consists of several decoding blocks 803*a*, 803*b*, 803*c*. The decoding block 814 receives the coding method information 811 from the data transfer channel 5. The coding method information is used to control the selection of decoding block 803*a*, 803*b*, 803*c* used at each bit rate, which is illustrated in FIG. 6 by the switches 802, 804. The invention is not limited to the selection of a decoding block according to FIG. 6, but any known construction can be used in different embodiments of the invention. The decoded speech is taken to the postfilter 808. The postfilter can comprise long-term filtering blocks, short-term filtering blocks or a combination thereof. The postfilter 808 filters the decoded speech signal and forms the output signal 809 of the decoder.

In the embodiment of FIG. 6, the selection of the weighting factors of the postfilter can be carried out on the basis of the average bit rate. The average calculation block 801 can calculate the average bit rate on the basis of the following formula, for example:

$$\text{ave_rate}_i=\alpha\cdot\text{bit_rate}_i+(1-\alpha)\cdot\text{ave_rate}_{i-1} \tag{9}$$

wherein $\alpha$ is the constant that determines the averaging period and $\text{bit_rate}_i$ is the bit rate of each frame i. For example, if the average is determined on the basis of 3000 frames or a period of 60 seconds with the ordinary frame length, the value of the factor $\alpha$ is 1/3000. However, the invention is not restricted to using an average calculated for a period of 3000 frames, but the average can also be determined for a period of different length. The suitable period can be determined for each application e.g. by means of listening tests. When the average bit rate is low, strong postfiltering is needed. On the other hand, a high average bit rate ensures that the quality of the transmitted speech is relatively good, whereby the postfiltering needs not to be very strong. The postfilter block 808 can use a short-term filter block according to Formula 5, for example. The weighting factors $\gamma_1$ and $\gamma_2$ of a postfilter according to Formula 5 can preferably be selected according to the following table, for example:

| Bit rate | Weighting factors | |
|---|---|---|
| kbit/s | γ1 | γ2 |
| over 8.0 | 0.75 | 0.85 |
| 8.0–6.0 | 0.7 | 0.85 |
| under 6.0 | 0.6 | 0.85 |

For frames containing unvoiced speech or background noise, postfiltering is weakened so as to prevent the tone of these frames from being distorted because of too strong filtering. If the voiced/unvoiced indicating block 806 detects that the speech signal of the frame being examined is unvoiced, or the background noise detection block 807 detects that the frame being examined contains background noise, the postfiltering control block 805 changes the weighting factors of the filter so that the frame in question is filtered less than normally.

Information corresponding to the voiced/unvoiced classification and the background noise/speech signal classification can also be received from the coder that coded the speech signal, if the coder transmits this information through the data transfer channel. In an application like this, the voiced/unvoiced indication block 806 and the background noise indication block 807 are not needed.

The amount of filtering reduction needed is preferably selected on the basis of what kind of a decoding block is being used at the time. A suitable reduction for different methods of speech coding can be determined with listening tests, for example. If a postfilter according to Formula 5 is being used, and the background noise increases, the value of the weighting factor $\gamma_i$ can be increased e.g. by 0.05 per each 10 dB reduction of the signal-to-noise ratio. The strength of the postfiltering can also be varied according to the coding error, that is, for instance according to the signal e(n) shown in FIG. 1. Information of the coding error can be transmitted to the decoder, whereby the strength of postfiltering is preferably increased while the amount of coding error increases.

The voiced/unvoiced indication and an estimate of the strength of background noise can also be received via the data transfer channel. This is possible if, for instance, the device that coded the speech sends this information to the decoder as part of the parameters of the speech to be transferred.

In one preferred embodiment of the invention, the weighting factors of the postfilter are also adjusted on the basis of the quality of the data transfer connection. Operation like this is illustrated by the determination block 810 in FIG. 6, which determines the quality of the data transfer connection and the bit error rate of the speech signal, and in which the quality of the data transfer connection 5 is estimated. Possible tools for estimating the quality of the data transfer connection include e.g. the Carrier to Interference (C/I) or the characteristic Bit Error Ratio (BER) of the received and coded speech signal. A characteristic describing the bit error rate of the speech signal or other characteristic describing the degree of correctness of the speech signal can also be used directly for adjusting the operation of the postfiltering. In an application like this, postfiltering is strengthened when the quality of the data transfer connection deteriorates or the bit error rate of the speech signal increases. In this way, data transfer connections are covered better than in the prior art solutions. For example, the value of the weighting factor $\gamma_1$ can be reduced by 0.05 per each 10 dB reduction of the C/I number. Adjustment of the postfilter according to the quality of the data transfer connection can also be implemented by the average bit rate, if the ratio of channel coding to speech coding is changed according to the quality of the data transfer connection. In poor circumstances, the proportion of channel coding is increased, whereby the bit rate of speech coding and also the average bit rate is reduced, and whereby the postfiltering to be adjusted according to the average bit rate is indirectly adjusted also on the basis of the quality of the data transfer connection.

Upper and lower limits can be set for the weighting factors so that the postfiltering would not become too strong when the data transfer connection is suddenly weakened. For instance, when using a postfilter according to Formula 5, a suitable lower limit for the weighting factor $\gamma_1$ is 0.55 and a suitable upper limit is about 0.9. These values are here presented only by way of example, and they do not restrict the values used in different embodiments of the invention.

The above examples have illustrated the adjustment of the strength of postfiltering by means of the weighting factor $\gamma_1$. However, this does not restrict the various embodiments of the invention, because the value of the weighting factor $\gamma_2$ can also be changed for changing the strength of the postfiltering.

The weighting factors of the long-term postfiltering block are preferably adjusted by the same criteria as the weighting factors of the short-term postfiltering block. In addition, in the case of frames containing unvoiced speech, the long-term postfiltering can be conveniently omitted. On the other hand, at frames containing strongly voiced sounds it is advantageous to use strong long-term postfiltering. The following table shows an example of the values of the weighting factor b of a long-term postfilter according to Formula 2 in different situations:

| The signal of the frame | The value of b at a low average bit rate | The value of b at a high average bit rate |
|---|---|---|
| unvoiced | 0 | 0 |
| voiced | 0.15β | 0.1β |
| strongly voiced | 0.3β | 0.2β |

FIG. 7 illustrates the operation of a postfilter according to one preferred embodiment of the invention. The topmost curve represents the coefficients produced by the short-term analysis block of a coder that coded a speech signal, which coefficients closely match the spectrum of the speech signal in question. The two curves of the lower graph represent the frequency response of a postfilter according to Formula 5 with different values of the weighting factors. The solid line represents a frequency response according to the weighting factors $\gamma_1$=0.6 and $\gamma_2$=0.8, and the broken line represents a frequency response according to $\gamma_1$=0.7 and $\gamma_2$=0.8. As is seen from the figure, the stronger the short-term postfilter block, the stronger its emphasis on the formants of the spectrum of the speech signal.

FIG. 8 illustrates a postfilter according to a preferred embodiment of the invention. The structure of this example partly resembles that of the postfilter in FIG. 3, but this embodiment also includes a filter control block 103, which adjusts the weighting factors of the short and long-term filter blocks on the basis of external parameters, for instance given by the decoder or transferred along the data transfer channel. To advantage, these parameters include e.g. the voiced/unvoiced V/UV classification of each frame, bit rate, the parameter set a(i) used by the coder that coded the speech signal, the coefficients $g_1$ and b, the weighting factors $\gamma_1$ and $\gamma_2$ and various characteristics describing the quality of the data transfer channel or the degree of correctness of the received and coded speech signal.

The pitch of decoded speech is analyzed in the analysis block 40. The operation of the long-term postfilter block 42 is controlled by the analysis results formed by the analysis block 40. The long-term postfilter block 42 is preferably a comb filter, whereby the locations of the peaks of the frequency response of the filter are adjusted according to the analysis results of the analysis block 40. The control block 103 also adjusts the operation of the long-term postfilter block according to the parameters coming from the decoder. Parameters like this can preferably include e.g. the average bit rate used in transmitting decoded speech, the coefficients $g_1$ and b and the voiced/unvoiced classification of each frame. The control block 103 adjusts the strength of the long-term postfiltering e.g. by means of the scaling factor $g_1$ according to Formula 2. At a unvoiced frame, the control block 103 prevents long-term postfiltering for instance by setting the scaling factor $g_1$ as zero. The control block preferably adjusts the operation of the long-term postfiltering block by means of the weighting factor b according to the Formula 2.

The control block 103 controls the operation of the short-term postfilter block 43 on the basis of the coefficient set a(i) received from the decoder and the weighting factors $\gamma_1$ and $\gamma_2$. The filtered signal is scaled to the strength of the decoded signal by means of the scaling factor calculation block 41 and the scaling block 44 according to the Formulas 7 and 8, for instance. According to the example shown in FIG. 8, the control block 103 controls the operation of the postfilter blocks 42, 43 on the basis of the weighting and other coefficients g, b, $\gamma_1$ and $\gamma_2$. However, the invention is not limited to a solution like this, but the control block 103 can determine the values of these coefficients e.g. by means of the average bit rate and the tables presented above or by other means. For example, the control block 103 can also control the operation of the long-term postfilter block by adapting the value of the weighting factor b on the basis of the average bit rate according to the table presented above. The control block can also control the operation of the postfilter block on the basis of the average bit rate by adapting the values of the weighting factors $\gamma_1$ and $\gamma_2$ conveniently according to the above table and the formulas 5 and 6, for instance.

FIG. 9 shows a block diagram of a mobile station according to one exemplary embodiment of the invention. The mobile station comprises parts typical of the device, such as microphone 301, keypad 307, display 306, earphone 314, transmit/receive switch 308, antenna 309 and control unit 305. In addition, the figure shows transmit and receive blocks 304, 311 typical of a mobile station. The transmission block 304 comprises a coder 321 for coding the speech signal. The transmission block 304 also comprises operations required for channel coding, deciphering and modulation as well as RF functions, which have not been drawn in FIG. 9 for clarity. The receive block 311 also comprises a decoding and postfiltering block 320 according to the invention. The decoding and postfiltering block 320 comprises a postfilter 322, which can preferably be a postfilter like the one shown in FIG. 8. The signal coming from the microphone 301, amplified at the amplification stage 302 and digitized in the A/D converter is taken to the transmit block 304, typically to the speech coding device comprised by the transmit block. The transmission signal processed, modulated and amplified by the transmit block is taken via the transmit/receive switch 308 to the antenna 309. The signal to be received is taken from the antenna via the transmit/receive switch 308 to the receiver block 311, which demodulates the received signal and decodes the deciphering and the channel coding. The resulting speech signal is taken via the D/A converter 312 to an amplifier 313 and further to an earphone 314. The control unit 305 controls the operation of the mobile station, reads the control commands given by the user from the keypad 307 and gives messages to the user by means of the display 306.

A postfilter according to the invention can also be used in a telecommunication network, such as an ordinary telephone network or a mobile station network, such as the GSM network. FIG. 10 shows an example of a block diagram of such a preferred embodiment of the invention. For example, the telecommunication network can comprise telephone exchanges or corresponding switching systems 360, to which ordinary telephones 370, base stations 340, base station controllers 350 and other central devices 355 of telecommunication networks are coupled. Mobile stations 330 can establish connection to the telecommunication network via the base stations 340. A decoding and postfiltering block 320 according to the invention can be particularly advantageously placed in the base station 340, for instance. However, the invention is not limited to this, but a decoding and postfiltering block 320 according to the invention can also be placed in the base station controller 350 or other central or switching device 355, for example. If the mobile station system uses separate transcoders e.g. between the base stations and base station controllers for transforming the coded signal taken over the radio channel into a typical 64 kbit/s signal transferred in a telecommunication system and vice versa, the decoding and postfiltering block 320 according to the invention can also be placed in such a transcoder. In general, the decoding and postfiltering block 320 according to the invention can be placed in any element of the telecommunication network, which transforms the coded data stream into an uncoded data stream. The decoding and postfiltering block 320 decodes and filters the coded speech signal coming from the mobile station 330, whereafter the speech signal can be transferred in the usual manner as uncompressed forward in the telecommunication network. The decoding and postfiltering block 320 can be implemented like any of the embodiments of the postfilter described in this patent application.

As an advantage of adaptive postfiltering it can be mentioned that the tone of the postfiltered voice does not change from frame to frame. When the weighting factors of the postfilter are adapted according to the long-term average bit rate, the speech tone is even and does not change disturbingly quickly.

The solution according to the invention has clear advantages as compared to the prior art solutions, because at a low average bit rate it is also possible that bursts of frames coded at high bit rates occur in the coded speech signal. If postfiltering is adapted on the basis of the momentary bit rate, like in the prior art solutions, different weighting factors would be used in the filtering of these bursts than in the filtering of frames of low bit rate, which would result in quick and disturbing changes in the tone of the decoded speech.

The invention can be applied at many points in different data transfer systems. In general, the invention can be used in all such parts of the data transfer system in which the coded speech signal is decoded. The invention can thus be used, for example, in a mobile station or other types of wireless or fixed terminal devices of a data transfer system, or in the central and switching devices of telephone systems.

In the above embodiments of the invention presented by way of example it has been assumed that the postfilter has both long-term and short-term postfiltering blocks. However, the invention is not limited to this, but it can also be applied to a construction in which the postfilter has only one postfilter block.

The above formulas 2 and 5 are only examples of prior art postfilters. The invention is not limited to this, but other kinds of filters can also be used as filters.

The invention can be applied to all kinds of data transfer systems transmitting speech. The invention can be applied regardless of the bit rate determination basis used in each application.

In this application the term background noise means, in addition to actual noise, also all other background sounds that are not part of the actual speech signal, but caused by traffic, equipment, people and animals.

In the above, the invention has been described with reference to its preferred embodiments, but it will be clear that the invention can be modified in many ways according to the inventive idea defined by the attached claims.

What is claimed is:

1. A method for filtering a decoded speech signal transferred at a variable bit rate, characterized in that the weighting factors of filtering are adapted according to the average bit rate, which average is calculated over a certain, predetermined length of time.

2. A method according to claim 1, wherein the speech signal is processed in frames of a certain length, characterized in that the weighting factors of the filtering are adapted according to the average bit rate, whereby the average is calculated over a period of at least two frames.

3. A method according to claim 1, wherein the speech signal is processed in frames of a certain length and wherein the part of the speech signal contained by each frame is classified as voiced or unvoiced, characterized in that the weighting factors used in the filtering of each frame are adapted on the basis of the voiced/unvoiced classification of the part of the speech signal contained by said frame.

4. A method according to claim 1, wherein the speech signal is processed in frames of a certain length and wherein the part of the speech signal contained by each frame is classified as background noise or speech, characterized in that the weighting factors used in the filtering of each frame are adapted on the basis of the background noise/speech classification of the part of the speech signal contained by said frame.

5. A method according to claim 1, in which method a speech signal transferred via a data transfer channel is processed, characterized in that the weighting factors of the filtering are adapted on the basis of the quality of the data transfer channel.

6. A method according to claim 1, characterized in that the weighting factors of filtering are adapted on the basis of the bit error rate of the transferred speech signal.

7. A method according to claim 1, characterized in that it comprises a phase in which information of a coding error occurred during the coding of the received speech signal, and the weighting factors of filtering are adapted on the basis of the coding error information.

8. A decoding system for decoding a speech signal coded at a variable bit rate, characterized in that it comprises a postfiltering block for filtering the speech signal and a postfiltering block control means for adjusting the operation of the postfiltering block according to the average bit rate calculated on the basis of a predetermined length of time.

9. A decoding system according to claim 8 for decoding a speech signal coded in frames of a certain length, characterized in that the postfiltering block control means is arranged to control the filtering of each frame in the postfiltering block also according to the voiced/unvoiced classification of the part of the speech signal contained by said frame.

10. A decoding system according to claim 8 for decoding a speech signal coded in frames of a certain length, characterized in that the postfiltering block control means is arranged to adapt the filtering of each frame in the postfiltering block also according to the background noise/speech signal classification of the part of the speech signal contained by said frame.

11. A decoding system according to claim 8 for decoding a coded speech signal transferred via a data transfer channel, characterized in that it comprises a device for determining the quality of the data transfer connection, whereby the postfiltering block control means is arranged to adapt the operation of the postfiltering block also on the basis of the quality of the data transfer channel.

12. A decoding system according to claim 8, characterized in that it comprises a device for determining the bit error rate of the speech signal, whereby the postfiltering block control means is arranged to adapt the operation of the postfiltering block on the basis of the bit error rate of the coded speech signal.

13. A mobile station, which is arranged to receive a speech signal coded at a variable bit rate, characterized in that it comprises a postfiltering block for filtering a decoded speech signal and a postfiltering block control means for adapting the operation of the postfiltering block according to the average bit rate calculated on the basis of a predetermined length of time.

14. An element of a telecommunication network, which is arranged to receive a decoded speech signal, characterized in that it comprises a decoding and postfiltering block, which further comprises a postfiltering block for filtering the decoded speech signal and a postfiltering block control means for adapting the operation of the postfiltering block according to the average bit rate calculated on the basis of a predetermined length of time.

* * * * *